United States Patent [19]

Bocher

[11] Patent Number: 4,585,289

[45] Date of Patent: Apr. 29, 1986

[54] COAXIAL CABLE CORE EXTENSION

[75] Inventor: Jean L. Bocher, Ermont, France

[73] Assignee: Societe Anonyme Dite: Les Cables de Lyon, Clichy, France

[21] Appl. No.: 607,045

[22] Filed: May 4, 1984

[30] Foreign Application Priority Data

May 4, 1983 [FR] France ..... 83 07408

[51] Int. Cl.[4] ..... H01R 17/04

[52] U.S. Cl. ..... 339/89 C; 339/177 E

[58] Field of Search ..... 339/89 C, 90 C, 177 R, 339/177 E; 403/297; 174/75 C, 88 C

[56] References Cited

U.S. PATENT DOCUMENTS

| | | | |
|---|---|---|---|
| 2,687,547 | 8/1954 | Matter | 403/297 |
| 2,822,418 | 2/1958 | Dinnick | 174/88 |
| 3,291,895 | 12/1966 | Van Dyke | 339/177 R |
| 3,350,500 | 10/1967 | Ziegler, Jr. | 174/88 C |
| 3,453,376 | 7/1969 | Ziegler, Jr. et al. | 174/75 C |

FOREIGN PATENT DOCUMENTS

| | | | |
|---|---|---|---|
| 634026 | 2/1928 | France . | |
| 2504738 | 10/1982 | France . | |
| 900393 | 7/1962 | United Kingdom | 339/177 E |
| 1477465 | 6/1977 | United Kingdom | 403/297 |

OTHER PUBLICATIONS

"Catalogue General Radio", 1978, p. 239.

*Primary Examiner*—John McQuade
*Attorney, Agent, or Firm*—Sughrue, Mion, Zinn, Macpeak and Seas

[57] ABSTRACT

Extension (1) of a coaxial cable core (21) made of a tube. This extension is characterized by the fact that it includes a cylindrical socket (2) with tapered end (4) of a diameter larger than the inner diameter of the tube and made flexible by longitudinal slots (6), a polygonal nut (10) of which angles (11) are introduced in longitudinal slots (6) of socket (2), a traction screw (12) which is screwed into the nut and includes a pick-up end (16); this traction screw abutting against the tube, after introducing the nut into socket (2), then this socket in core (21), thus pulling the nut longitudinally to push apart and tighten the flexible tapered section on core (21) inner wall (21').

4 Claims, 5 Drawing Figures

COAXIAL CABLE CORE EXTENSION

FIELD OF THE INVENTION

This invention relates to a coaxial cable core extension made of a tube.

It also concerns a connector fitted with such a core extension.

The cores of coaxial cables are made either of a thin tube, or nowadays of a thin strip welded lengthways. The core extensions of the former state of the art used in coaxial cables in which the core is made of a thin tube are not appropriate anymore for cables made today in which the core is made of a thin welded strip.

These former extensions are for example:

- a cylindrical connecting piece which is welded onto the extremity of the core,
- a threaded connecting piece which is screwed directly into the core inner diameter,
- a threaded connecting piece which ensures self-tapping of the cable inner diameter.

These three extensions require a very accurate inner diameter of the core and therefore, a difference in diameter greater than 0.3 mm requires the use of a different size of extension. One such extension takes the form of an elastic clip of the "banana plug" type which absorbs greater variations of the core diameter (approximately 0.5 mm). However, the electrical contact is weaker, and also this clip can slip in the core of the cable. Another extension takes the form of a notched cylindrical socket which includes one single longitudinal slot and is fitted with a tapered nut. However, this socket is never totally centered in a welded tube because the annealing differences on the tube do not allow even penetration of the notched portion of the socket in the tube.

Cables of the same size but from various sources often have important differences in the core inner diameter and this invention allows to compensate for this disadvantage by offering a core extension capable of absorbing differences in the diameter of up to 1 mm.

This invention also offers another advantage, ie. the self-centering of the extension in the tube as it is screwed in.

SUMMARY OF THE INVENTION

The extension of this invention is characterised by the fact that it includes a cylindrical socket with a tapered end of a greater diameter than the inner diameter of the tube and made flexible by its longitudinal slots, a polygonal nut of which the angles are introduced in the longitudinal slots of the socket, a traction screw which is screwed into the nut and includes a pick-up end, this traction screw abutted against the tube, after the nut has been introduced in the socket and the socket in the core, thus pulling the nut lengthways to push apart and tighten the flexible tapered part on the inner wall of the core.

Another advantage is that since the nut is square, its 4 angles are each slipped into a longitudinal slot.

Preferably, the other end of the traction screw is guided in a bore of the socket.

The connector of this invention, equipped with a cable core extension which includes from its centre outwards: a central core, an insulating layer, an outside conductor and an external insulating layer, is characterised by the fact that the pick-up end of the traction screw is made of two smooth counterbores.

Advantageously, this connector includes a central tube slipped onto the smooth counterbore of the pick-up end.

As an example and with reference to the figures of the attached drawing, an extension according to this invention and a connector fitted with such an extension are described below.

DESCRIPTION OF THE PREFERRED EMBODIMENT

Figure 1:
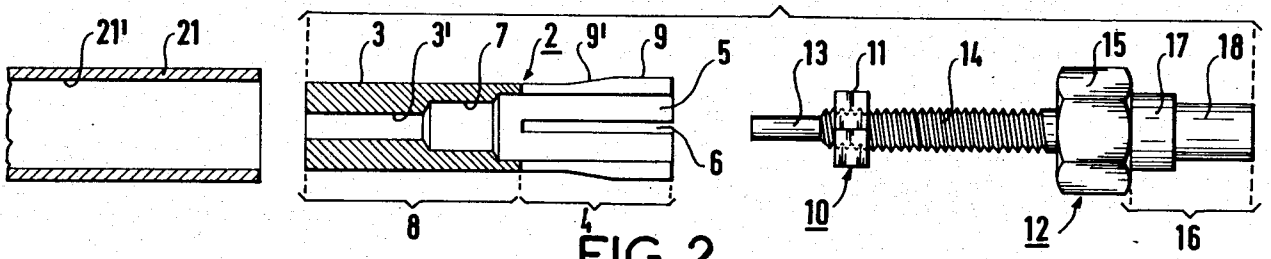
FIG. 1 is an exploded sectional view of the extension forming one embodiment of the invention.

In FIG. 1, we can see cable core (21) and its inner wall (21'). We can also see on the exploded view, extension (1) made of socket (2), nut (10) and tightening screw (12). Socket (2) has two separate ends: one rigid end (8) with an outer diameter (3) having an internal bore of (3') and a greater diameter bore (7), a flexible end (4) equipped with four lugs (5) separated by longitudinal slots (6), which can be seen better in FIG. 3. These lugs (5) define externally, a cylinder (9) connected to the outer diameter (3) of the rigid end (8) by a cone (9'). Nut (10) which can be seen better in FIG. 3, has four angled corners (11).

The traction screw (12) includes an hexagonal tightening head (15), a threaded section (14), a cylindrical section (13) and a pick-up end (16) comprising two reduced diameter cylindrical portions, (17 and 18).

Figure 2:
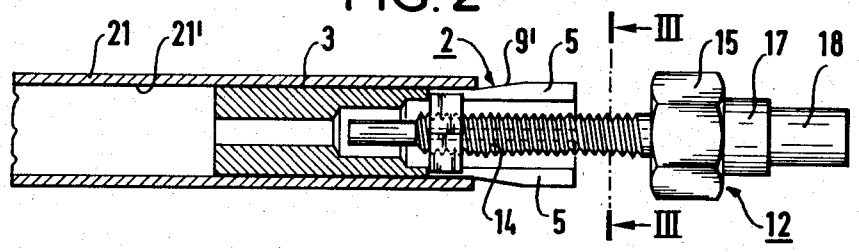
FIG. 2 is a sectional view which shows the extension positioned in the core of the coaxial cable.

In FIG. 2 which shows the positioning of the extension in the cable core, we can see that rigid section (8) of socket (2) is introduced inside core (21), up to the level of cone (9) and that nut (10) previously screwed onto the end of threaded section (14) of traction screw (12) is introduced in slotted portion of the socket until it is abutted against rigid section (8).

Figure 3:
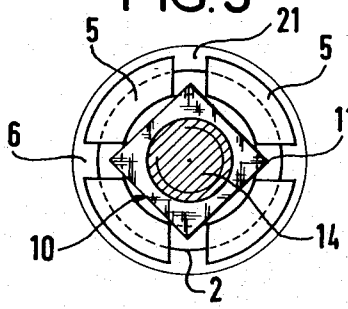
FIG. 3 is a cross-section along III of FIG. 2, showing the particular shape of a nut slipped in the longitudinal slots of the extension socket.

FIG. 3, which is a cross-section along III of FIG. 2, shows that the four angled corners (11) of nut (10) penetrate the longitudinal slots (6) of socket (2).

Figure 4:
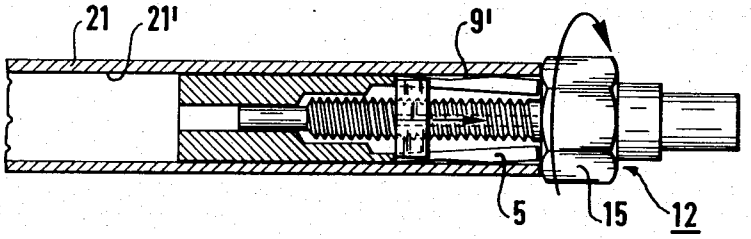
FIG. 4 is a sectional view which shows the extension in its tightening position.

In FIG. 4, which shows the extension ready to be tightened in cable core (20), we can see that socket (2) is completely introduced in the core and that lugs (5) are distorted because of the action of cone (9') and reduce the width of slots (6).

The extension is positioned in the cable core in the following way:

Nut (10) is screwed onto threaded section (14) of traction screw (12), then is introduced in the socket, the socket-nut-traction screw assembly is then introduced in the core up to the level of cone (9') of the socket, then by pinching these, up to the extremity of lugs (5). All one has to do is then to tighten the traction screw and as soon as it is abutted against core (21), the nut slips into tightened slots (6) and tightens socket (2) on wall (21') of core (21) by pushing lugs (5) apart.

Figure 5:
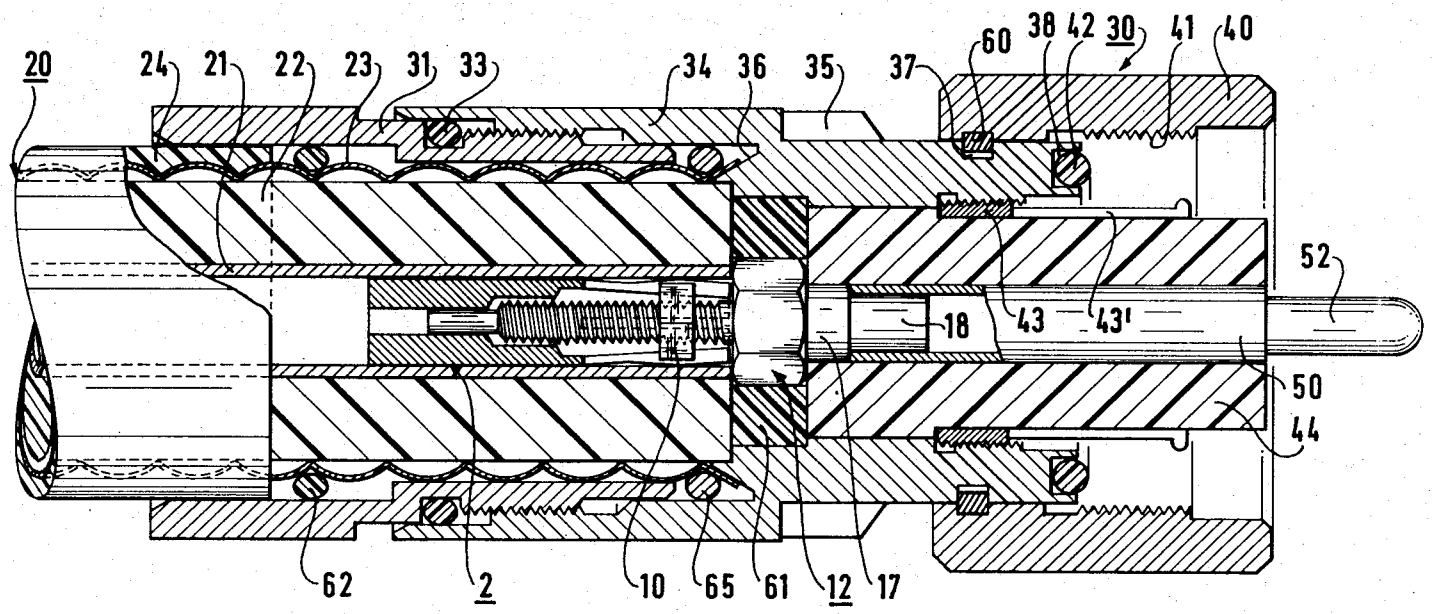
FIG. 5 is an enlarged view in section which shows a coaxial cable connector fitted with such a core extension.

In FIG. 5, which shows the extension positioned in a connector, we can see this connector comprising of socket (2), nut (10) and traction screw (12) fitted with one pick-up end made of two cylindrical portions (17,18). This extension is placed in core (21) of coaxial cable (20) which also includes an insulating layer (22) around core (21) and an outer undulated conductor (23) covered by an outer layer (24).

This connector (30) includes a main socket (31) covering the end of external layer (24) of cable (20), another socket (34) screwed on socket (31) and resting on insulating layer (22) of cable, a nut (40) secured in translation by a ring (60) permanently mounted in a groove (37) of socket (34), a slotted piece (43) screwed into socket (34) and including lugs (43'), a tube (50) fitted over the cylindrical portion (18) of the traction screw and with a ferrule (52).

An O-ring (62) is placed between outer conductor (23) and socket (31) and another O-ring (33) ensures tightness between sockets (31) and (34). A metal ring (65) pushes the end of the outer conductor (23) onto a cone (36) of socket (34) tightened by means of a spanner to be engaged in notches (35).

Washer (61) surrounds tightening head (15) and an insulating layer (44) in polythene for example, covers cylindrical portion (17) of the traction screw and tube (50) up to the level of its ferrule (52).

Ferrule (52) and lugs (43') go into a standard connecting socket (not shown) while nut (40) is screwed on this socket. Tightness between connector (30) and this socket is ensured by a seal (42) placed in a groove (38) of socket (34).

Without departing from the matter of this invention, this extension can be used in all types of coaxial cable connectors or to connect the cores of two coaxial cables, by transforming the pick-up end of the traction screw into a threaded stem corresponding to the threaded part of the screw but with reverse pitch, and by adding another nut and another socket in the core of the second cable.

I claim:

1. Extension (1) of a coaxial cable (20) core (21), said core constituting a tube, said extension comprising:

a cylindrical socket (2) with a tapered end (4) of an outer diameter larger than the inner diameter of the tube (21) and made flexible by longitudinal slots (6), a polygonal nut (10) having angled corners (11) introduced in said longitudinal slots (6) of socket (92), a traction screw (12) screwed into the nut and including a pick-up end (16), said traction screw being stopped against the tube (21), after previous introduction of the nut (10) in socket (2), then socket (2) in tube (21), pulling the nut longitudinally to push apart and tighten the flexible tapered end onto inside wall (21') of tube (21).

2. Extension of a coaxial cable core as per claim 1, characterised by the fact that nut (10) is square, its four angled corners (11) being each slipped into a longitudinal slot (6).

3. An extension of a coaxial cable core according to claim 1, wherein the other end (13) of the traction screw is guided through a bore (3') of the socket.

4. In combination, a connector (30) and coaxial cable core extension (1) for a cable including the following elements from its center outwards:

a central core (21), said central core (21) constituting a tube, an insulating layer (22), an outer connector (23) and an outer insulating layer (24), said cable core extension comprising:

a cylindrical socket (2) with a tapered end (4) of an outer diameter larger than the inner diameter of the tube and made flexible by longitudinal slots (6), a polygonal nut (10) having angled corners (11) introduced in said longitudinal slots (6) of socket (2), a traction screw (12) screwed into the nut and including a pick-up end (16), said traction screw being stopped against the tube, after previous introduction of the nut in socket (2), then socket (2) in tube (21), pulling the nut longitudinally to push apart and tighten the flexible tapered end onto inside wall (21') of tube (21), said connector comprising a main socket (31) covering said outer insulating layer (24) of cable (20), a further socket (34) screw mounted to socket (31) and resting on insulating layer (22), said further socket (34) bearing a groove (37), a nut (40) secured against translation by ring (60) permanently mounted in said groove (37) of said socket (34), a slotted piece (43) screwed into said socket (34), said slotted piece including lugs (43'), said traction screw (12) terminating at its end remote from said coaxial cable in a first cylindrical portion (17), and a second cylindrical portion (18) of reduced diameter, another tube (50) fitted over said second cylindrical portion (18) of said traction screw (12), said another tube (50) terminating in a ferrule (52) at its end remote from said traction screw cylindrical portion (18), said traction screw (12) including a tightening head (15), a washer (61) surrounding said tightening head, an insulating layer (44) covering said cylindrical portion (17) of the traction screw and tube (50) to the level of said ferrule (52), and wherein said slotted piece (43) screwed into said socket (34) maintains said washer (61) in position surrounding said tightening head (15), and said insulating layer (44) surrounding the cylindrical portion (17) of the traction screw and said tube (50).

* * * * *